US009254688B2

(12) United States Patent
Honobe

(10) Patent No.: US 9,254,688 B2
(45) Date of Patent: Feb. 9, 2016

(54) LIQUID EJECTING APPARATUS

(71) Applicant: SEIKO EPSON CORPORATION, Tokyo (JP)

(72) Inventor: Yuichi Honobe, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/486,577

(22) Filed: Sep. 15, 2014

(65) Prior Publication Data

US 2015/0097887 A1 Apr. 9, 2015

(30) Foreign Application Priority Data

Oct. 3, 2013 (JP) ..... 2013-207964

(51) Int. Cl.
*B41J 11/02* (2006.01)
*B41J 11/00* (2006.01)
*B41J 3/28* (2006.01)

(52) U.S. Cl.
CPC . *B41J 11/002* (2013.01); *B41J 3/28* (2013.01); *B41J 11/0085* (2013.01)

(58) Field of Classification Search
CPC ..... B41J 29/38; B41J 11/002; B41J 11/0035; B41J 11/20; B41J 25/308
USPC ..... 347/16
See application file for complete search history.

(56) References Cited

U.S. PATENT DOCUMENTS

2011/0102527 A1* 5/2011 Tamaki et al. ..... 347/102
2012/0194598 A1 8/2012 Fujisawa et al.
2012/0293575 A1* 11/2012 Shimada et al. ..... 347/9

FOREIGN PATENT DOCUMENTS

JP 2010-152129 7/2010
JP 2012-158105 8/2012
JP 2012-240337 12/2012

* cited by examiner

*Primary Examiner* — Justin Seo
*Assistant Examiner* — Michael Konczal
(74) *Attorney, Agent, or Firm* — Workman Nydegger

(57) ABSTRACT

A liquid ejecting apparatus includes: a liquid ejecting head that ejects a light-curable UV ink onto a medium; an irradiator that irradiates the UV ink ejected onto the medium with UV light and cures the UV ink; a control device that controls intensity of the UV light applied from the irradiator to the medium; and a carriage motor that moves the irradiator in one direction, in which the control device changes the intensity of the UV light applied from the irradiator to the medium while the carriage motor moves the irradiator in one direction.

6 Claims, 7 Drawing Sheets

FIG. 4
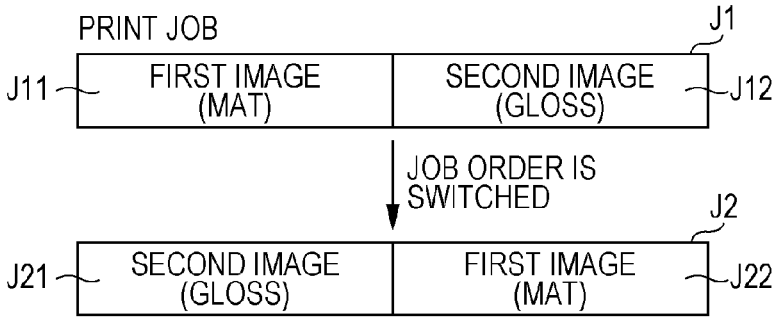
FIG. 5
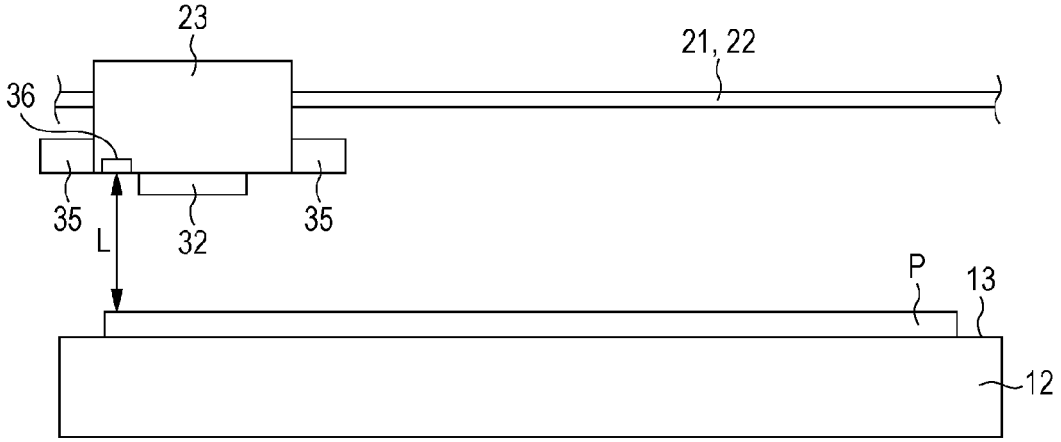
FIG. 6
T
| | MAT (FIRST LIGHT IRRADIATION MODE) | GLOSS (SECOND LIGHT IRRADIATION MODE) |
|---|---|---|
| LARGE DISTANCE (L ≥ THRESHOLD N) | 200 mA | 100 mA |
| SMALL DISTANCE (L < THRESHOLD N) | 180 mA | 90 mA |

T

| | MAT (FIRST LIGHT IRRADIATION MODE) | GLOSS (SECOND LIGHT IRRADIATION MODE) |
|---|---|---|
| LARGE DISTANCE (L ≥ THRESHOLD N) | 200 mA | 100 mA |
| SMALL DISTANCE (L < THRESHOLD N) | 180 mA | 90 mA |

LIQUID EJECTING APPARATUS

BACKGROUND

1. Technical Field

The present invention relates to a liquid ejecting apparatus ejecting light-curable liquid onto a medium.

2. Related Art

In the related art, an ink jet type printer is known which forms an image by ejecting a UV-curable (light-curable) ink (liquid) from a nozzle of a liquid ejecting head that is supported on a carriage reciprocating in a scanning direction onto a medium (for example, refer to JP-A-2012-240337).

In such a printer, an irradiation section configured of a plurality of light sources is supported on both sides of the liquid ejecting head in the carriage. Then, the ink is cured and fixed on the medium by applying UV light from the irradiation section on the ink ejected onto the medium while the carriage is reciprocated.

However, if gloss of the image that is formed by the ink ejected onto the medium is high, it is necessary that the printer cure the ink after the ink ejected onto the medium wet spreads. On the other hand, if the gloss of the image that is formed by the ink ejected onto the medium is low, it is necessary to cure the ink before the ink ejected onto the medium wet spreads. That is, it is necessary to change a curing velocity of the ink ejected onto the medium by changing intensity of the UV light applying on the medium to match a degree of the gloss required for the image formed on the medium.

However, the printer described above is configured such that the UV light having a constant intensity is applied to the medium while the carriage is reciprocated. Thus, if an image having different glosses is formed on the medium, it is necessary to repeat an operation to selectively irradiate a specific image in the medium with the UV light while the intensity of the UV light applying from the irradiation section to the medium is changed for every reciprocation of the carriage. In this case, since it is necessary to reciprocate the carriage a plurality of times, there is a problem that it is impossible to efficiently form the image having different glosses.

SUMMARY

An advantage of some aspects of the invention is to provide a liquid ejecting apparatus that is capable of efficiently forming an image having different glosses.

According to an aspect of the invention, there is provided a liquid ejecting apparatus including: a liquid ejecting section that ejects light-curable liquid onto a medium; a light irradiation section that irradiates the liquid ejected onto the medium with light, and cures the liquid; a control section that controls intensity of the light to be applied from the light irradiation section to the medium; and a driving section that moves the light irradiation section in a predetermined direction, in which the control section changes the intensity of the light to be applied from the light irradiation section to the medium while the driving section moves the light irradiation section in the predetermined direction.

According to the aspect, the image having different glosses is formed on the medium by changing the intensity of the light applied from the light irradiation section to the medium while the light irradiation section is moved in a predetermined direction. Thus, it is possible to efficiently form the image having different glosses.

Furthermore, in the liquid ejecting apparatus, it is preferable that the control section cause a plurality of light irradiation modes in which the intensities of the light applied from the light irradiation section to the medium are different from each other to be executed while the driving section moves the light irradiation section in the predetermined direction.

According to the aspect, the image having different glosses is formed on the medium by executing a plurality of light irradiation modes in which the intensities of the lights applied from the light irradiation section to the medium are different from each other while the light irradiation section is moved in a predetermined direction. Thus, it is possible to efficiently form the image having different glosses.

Furthermore, it is preferable that the liquid ejecting apparatus further include: a measuring section that measures a distance between the light irradiation section and the medium, in which the control section increases the intensity of the light applied from the light irradiation section to the medium in a case where the distance measured by the measuring section is a first distance, as compared to a case where the distance measured by the measuring section is a second distance that is smaller than the first distance.

According to the aspect, the intensity of the light applied from the light irradiation section to the medium is maintained by changing the intensity of the light applied from the light irradiation section to the medium depending on the change of the distance between the light irradiation section and the medium. Therefore, it is possible to form the image having a desired gloss on the medium even if the distance between the light irradiation section and the medium is changed.

Furthermore, in the liquid ejecting apparatus, it is preferable that the control section cause the light having a first intensity to be applied from the light irradiation section to a medium portion that is positioned on a rear side in a moving direction of the light irradiation section, and cause the light having a second intensity that is greater than the first intensity to be applied from the light irradiation section to a medium portion that is positioned on a front side in the moving direction of the light irradiation section while the driving section moves the light irradiation section in the predetermined direction.

According to the aspect, the light irradiation section irradiates the light having the first intensity to the medium and then the intensity of the light to be applied to the medium is increased from the first intensity to the second intensity while moving in a predetermined direction. Thus, when the intensity of the light to be applied from the light irradiation section to the medium is increased from the first intensity to the second intensity, the light having the first intensity has already been applied from the light irradiation section to the medium portion positioned on the rear side in the moving direction of the light irradiation section, thereby becoming a state where the ink is cured. Thus, immediately after the intensity of the light to be applied from the light irradiation section to the medium is increased from the first intensity to the second intensity, even if some of the light having the second intensity is to be applied from the light irradiation section to the end portion of the medium portion positioned on the rear side in the moving direction of the light irradiation section, the curing of the ink is further processed in the end portion thereof and the glossiness is unlikely to be changed thereby. Thus, even if the intensity of the light to be applied from the light irradiation section to the medium is continuously changed from the first intensity to the second intensity while the light irradiation section is moved in a predetermined direction, it is possible to suppress influence to the glossiness of the medium formed on a boundary thereof.

Furthermore, in the liquid ejecting apparatus, it is preferable that the control section cause the light having the first intensity to be applied from the light irradiation section to the medium that is positioned on the rear side in the moving direction of the light irradiation section, and cause the light having the second intensity that is smaller than the first intensity to be applied from the light irradiation section to the medium that is positioned on the front side in the moving direction of the light irradiation section, in a case of applying the light to a plurality of media while the driving section moves the light irradiation section in the predetermined direction.

According to the aspect, the light irradiation section irradiates the medium positioned on the rear side in the moving direction of the light irradiation section with the light having the first intensity and then the intensity of the light applied to the medium positioned on the front side in the moving direction of the light irradiation section is increased from the first intensity to the second intensity while moving in a predetermined direction. Thus, when the intensity of the light applied from the light irradiation section to the medium is increased from the first intensity to the second intensity, the light having the first intensity has already been applied from the light irradiation section to the medium positioned on the rear side in the moving direction of the light irradiation section, thereby becoming a state where the ink is cured. Thus, immediately after the intensity of the light applied from the light irradiation section to the medium is increased from the first intensity to the second intensity, even if some of the light having the second intensity is applied from the light irradiation section to the end portion of the medium positioned on the rear side in the moving direction of the light irradiation section, the curing of the ink is further processed in the end portion thereof and the glossiness is unlikely to be changed thereby. Thus, even if the intensity of the light applied from the light irradiation section to the medium is continuously changed from the first intensity to the second intensity while the light irradiation section is moved in a predetermined direction, it is possible to suppress influence to the glossiness of the medium formed on a boundary thereof.

Furthermore, it is preferable that the liquid ejecting apparatus further include: an ejection control section that controls ejection modes of the liquid ejected from the liquid ejecting section onto the medium, in which the ejection control section generates liquid ejection jobs so as to execute a first liquid ejection job and a second liquid ejection job in order while the liquid ejecting section is moved in the moving direction of the light irradiation section, and in a case where the intensity of the light applied to the image formed by the first liquid ejection job is greater than that of the light applied to the image formed by the second liquid ejection job, the order of the first liquid ejection job and the second liquid ejection job in the liquid ejection jobs be switched.

According to the aspect, when switching the order of the liquid ejection jobs, the image to which the light having the first intensity is applied is formed on the rear side in the moving direction of the light irradiation section and the image to which the light having the second intensity is applied is formed on the front side in the moving direction of the light irradiation section. Thus, it is possible to reliably realize a configuration in which the light having the first intensity is applied from the light irradiation section to the position of the rear side in the moving direction of the irradiator in the medium P and the UV light having the second intensity that is greater than the first intensity is applied from the light irradiation section to the front side in the moving direction of the light irradiation section in the medium or the medium portion while the driving section moves the light irradiation section in one direction.

Furthermore, it is preferable that the liquid ejecting apparatus further include: a notification section that promptly notifies disposition of each medium to dispose the medium to which the light having the first intensity from the light irradiation section is applied on the rear side in the moving direction of the light irradiation section and to dispose the medium to which the light having the second intensity from the liquid ejecting section is applied on the front side in the moving direction of the light irradiation section.

According to the aspect, in a case of arranging each of the media according to the notification from the notification section, the medium on which the image is formed and to which the light having the first intensity is applied is disposed on the rear side in the moving direction of the light irradiation section and the medium on which the image is formed and to which the light having the second intensity is applied is disposed on the front side in the moving direction of the light irradiation section. Thus, it is possible to reliably realize the configuration in which the light having the first intensity is applied from the light irradiation section to the medium positioned on the rear side in the moving direction of the light irradiation section and the light having the second intensity that is greater than the first intensity, is applied from the light irradiation section to the medium positioned on the front side in the moving direction of the light irradiation section while the driving section moves the light irradiation section in a predetermined direction.

BRIEF DESCRIPTION OF THE DRAWINGS

The invention will be described with reference to the accompanying drawings, wherein like numbers reference like elements.

FIG. 4 is a schematic view illustrating contents of a print job before and after the job order is switched.

FIG. 5 is a schematic view illustrating a peripheral configuration of the carriage in a state where a distance sensor measures a distance between an irradiator and a medium.

FIG. 6 is a schematic view illustrating a table indicating current values supplied to an LED in each irradiation condition.

DESCRIPTION OF EXEMPLARY EMBODIMENTS

First Embodiment

Hereinafter, a first embodiment embodying a liquid ejecting apparatus in an ink jet type printer will be described with reference to the drawings.

Figure 1:
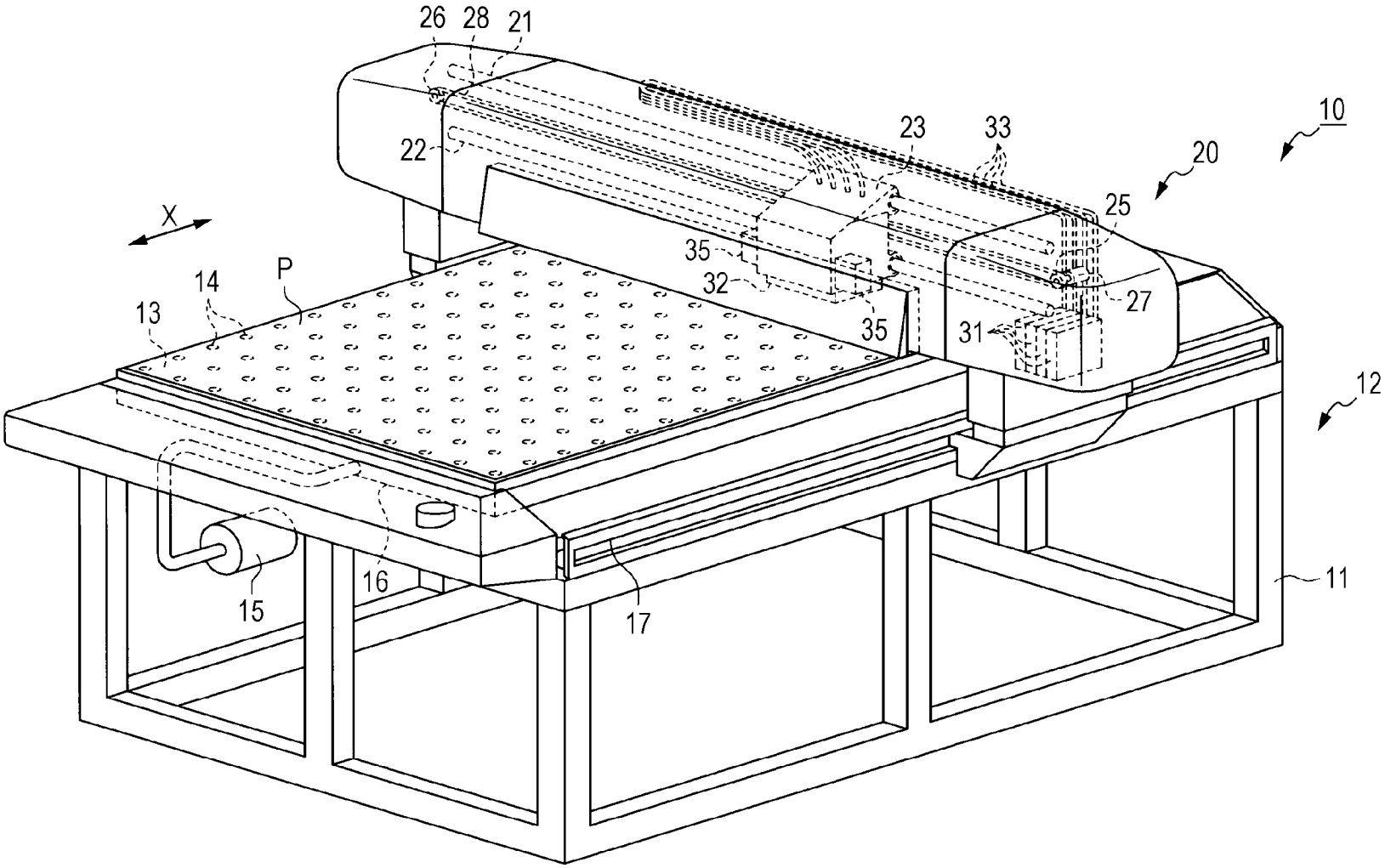
FIG. 1 is a schematic perspective view illustrating a printer of a first embodiment.

As illustrated in FIG. 1, a printer 10 includes a base stand 12 including a support table 11 of a frame structure to be placed on a floor surface. A mounting surface 13 on which a medium P is mounted is formed on an upper surface of the base stand 12 and a plurality of suction holes 14 open on the mounting surface 13. Furthermore, a pressure reducing chamber 16 connected to a vacuum pump 15 is provided in a lower portion of the mounting surface 13 of the base stand 12. Then, when driving the vacuum pump 15, the pressure reducing chamber 16 gains a pressure reduced atmosphere and thereby a suction force acts on the medium P mounted on the mounting surface 13 of the base stand 12 through the suction holes 14.

Guide grooves 17 (only one side is indicated in FIG. 1) are formed on both side surfaces of the base stand 12. Lower end portions of a gate-shaped liquid ejecting unit 20 that is lengthily extended in one direction are fitted into the guide grooves 17, which is capable of reciprocating along a longitudinal direction X of the medium P.

The liquid ejecting unit 20 has a main shaft 21 and a sub-shaft 22 along the longitudinal direction thereof. A carriage 23 is slidably supported on the shafts 21 and 22 along the longitudinal direction thereof.

A driving pulley 25 and a driven pulley 26 are rotatably supported in positions corresponding to both end portions of both shafts 21 and 22 in the liquid ejecting unit 20. An output shaft of a carriage motor 27 as an example of a driving section that is a drive source when reciprocating the carriage 23 is connected to the driving pulley 25 and an endless timing belt 28 of which a part is connected to the carriage 23 is wound around between a pair of pulleys 25 and 26. Therefore, the carriage 23 moves along the longitudinal direction of both shafts 21 and 22 through the endless timing belt 28 by a driving force of the carriage motor 27 while being guided by both shafts 21 and 22. Moreover, the liquid ejecting unit 20 is provided with a linear scale (not illustrated) along a moving direction of the carriage 23. Then, an encoder 29 (see FIG. 3) mounted on the carriage 23 outputs a signal of the number of pulses proportional to a moving distance of the carriage 23 through the linear scale.

Ink cartridges 31 storing UV-curable ink (hereinafter, referred to as "UV ink") as an example of the light-curable liquid are disposed on one end side (right end side in FIG. 1) in the longitudinal direction of the liquid ejecting unit 20. The UV ink inside the ink cartridge 31 is capable of supplying the UV ink inside the ink cartridge 31 to a liquid ejecting head 32 as an example of the liquid ejecting section supported on the lower surface side of the carriage 23 through an ink supply tube 33. Then, the liquid ejecting head 32 performs printing on the medium P mounted on the mounting surface 13 of the base stand 12 by ejecting the UV ink supplied from the ink cartridge 31 at an ejection timing that is set based on a signal output from the encoder 29.

Furthermore, a pair of irradiators 35 as an example of the light irradiation section are supported on side surfaces of the carriage 23. The irradiators 35 are supported on both sides of the liquid ejecting head 32 in the moving direction of the carriage 23. Then, each irradiator 35 cures the UV ink by applying the UV light to the UV ink ejected onto the medium P.

Figure 2:
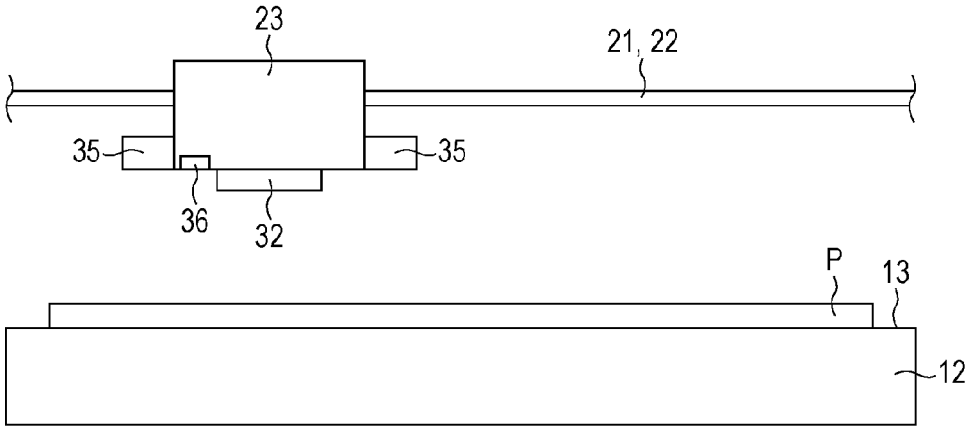
FIG. 2 is a schematic view illustrating a peripheral configuration of a carriage.

Furthermore, as illustrated in FIG. 2, a distance sensor 36 as an example of a measuring section that measures a distance between the medium P mounted on the mounting surface 13 of the base stand 12 and the irradiator 35 is provided on the lower surface of the carriage 23. Moreover, the distance sensor 36 is preferably a non-contact type sensor and, for example, it is possible to employ an ultrasonic sensor.

Next, a control configuration of the printer 10 will be described.

Figure 3:
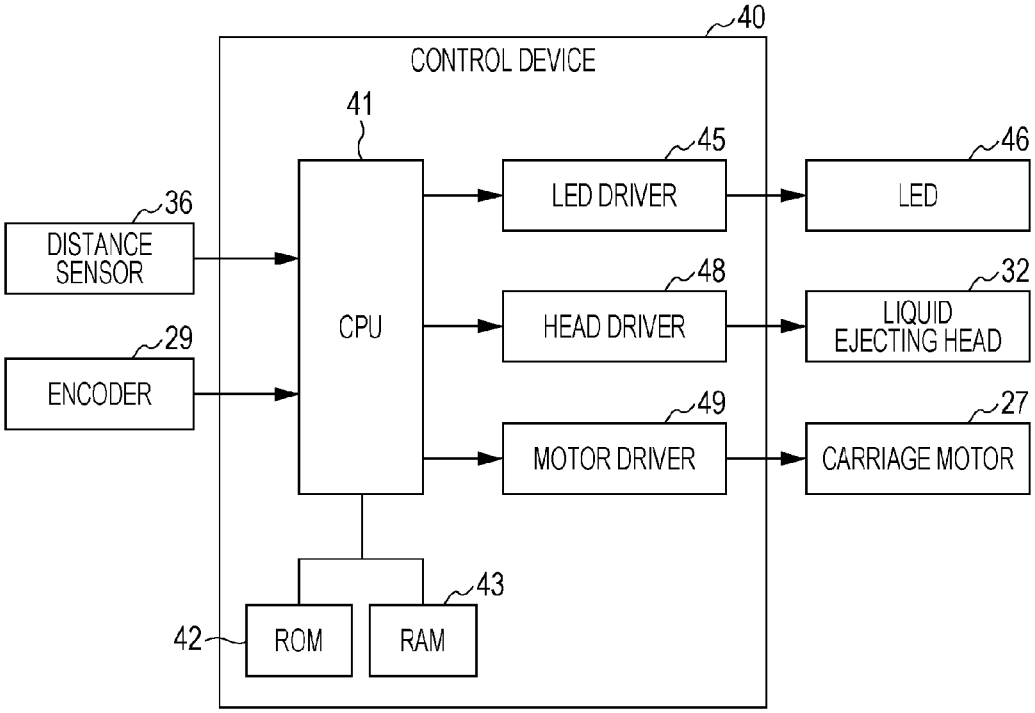
FIG. 3 is a block view illustrating a control configuration of the printer.

As illustrated in FIG. 3, the printer 10 includes a control device 40 as an example of a control section controlling intensity of the UV light applied from the irradiator 35 to the medium P. The control device 40 includes a CPU 41, a ROM 42, and a RAM 43.

The CPU 41 collectively controls operations of the printer 10, based on a signal input from the distance sensor 36 and the encoder 29. Specifically, the CPU 41 controls a supply mode of a current from an LED driver 45 to an LED 46 included in the irradiator 35 by transmitting a control signal to the LED driver 45. As a result, the CPU 41 controls an irradiation operation of the UV light from the irradiator 35 to the UV ink on the medium P.

Furthermore, the CPU 41 controls a supply mode of a voltage from a head driver 48 to the liquid ejecting head 32 (specifically, a piezoelectric element built into the liquid ejecting head 32) by transmitting a control signal to the head driver 48. As a result, the CPU 41 functions as an ejection control section that controls an ejecting operation of the UV ink from the liquid ejecting head 32 onto the medium P.

Furthermore, the CPU 41 controls the supply mode of the current from a motor driver 49 to the carriage motor 27 by transmitting the control signal to the motor driver 49. As a result, the CPU 41 controls a moving operation of the carriage 23.

The ROM 42 stores various data that are used when operating the printer 10 and, for example, stores data indicating current values supplied from the LED driver 45 to the LED 46 for each irradiation mode of the UV light from each irradiator 35 to the UV ink on the medium P. Moreover, in the embodiment, as an example, the ROM 42 stores two sets of data indicating the current values supplied from the LED driver 45 to the LED 46 corresponding to two irradiation modes depending on the distance between the liquid ejecting head 32 and the medium P (see FIG. 6).

The RAM 43 temporarily stores various data used when operating the printer and, for example, temporarily stores the print jobs indicating printing contents with respect to the medium P as data defining the ejection modes of the UV ink ejecting from the liquid ejecting head 32 onto the medium P.

Next, a procedure of a control process that is performed by the CPU 41 when the printer 10 performs the printing on the medium P will be described.

First, the CPU 41 generates a print job J1 as an example of the liquid ejection job onto the medium P based on a printing command that is input and stores the generated print job J1 in the RAM 43 when a printing command with respect to the medium P is input from the outside. In this case, the print job J1 includes data of setting values of glossiness (mat or gloss) formed in the image in association with the data of the image printed on the medium P.

Then, as illustrated in FIG. 4, the CPU 41 recognizes the order of the print jobs that print the image in the print job J1 that is input. Here, in the print job J1, first, a first print job J11 as an example of a first liquid ejection job that prints a first image G1 in which the setting value of the glossiness is low (mat) is executed and then a second print job J12 as an example of a second liquid ejection job that prints a second image G2 in which the setting value of the glossiness is high (gloss) is executed. In this case, the CPU 41 updates the print jobs J11 and J12 to a new print job J2 in which the order of the print jobs J11 and J12 is switched and stores the updated print job J2 in the RAM 43. That is, in the updated print job J2, first, a first print job J21 that prints the second image G2 in which the setting value of the glossiness is high (gloss) is executed and then a second print job J22 that prints the first image G1 in which the setting value of the glossiness is low (mat) is executed.

Furthermore, the CPU 41 controls driving of the carriage motor 27 by transmitting a control signal in which a printing command is input from the outside as a trigger to the motor driver 49.

Then, as illustrated in FIG. 5, the carriage 23 reciprocates along the longitudinal direction of the main shaft 21 and the sub-shaft 22 so as to cross over the medium P on the mounting surface 13 of the base stand 12. Then, the CPU 41 calculates a distance L between the irradiator 35 and the medium P based on a measurement signal input from the distance sensor 36 in the process of movement of the carriage 23. Then, the CPU 41 stores the data of the calculated distance L in the RAM 43.

Then, next, as illustrated in FIG. 6, the CPU 41 reads a table T indicating the current values supplied from the LED driver 45 to the LED 46 from the ROM 42 in each irradiation condition. Furthermore, the CPU 41 determines a magnitude relation between a threshold N that is set in the table T that is read and the data of the distance L calculated as described above. Then, the CPU 41 sets the current value depending on a determination result as the current value supplied from the LED driver 45 to the LED 46 and stores the data of the current values that are set in the RAM 43.

Specifically, the CPU 41 sets "200 mA" as the current value in the first light irradiation mode that irradiates the image in which the setting value of the glossiness is low (mat) with the UV light and sets "100 mA" as the current value in the second light irradiation mode that irradiates the image in which the setting value of the glossiness is high (gloss) with the UV light, in a case where the distance L calculated as described above is the first distance that is the threshold N or more. That is, the CPU 41 sets a value greater than the current value in the second light irradiation mode as the current value in the first light irradiation mode.

Furthermore, the CPU 41 sets "180 mA" as the current value in the first light irradiation mode that irradiates the image in which the setting value of the glossiness is low (mat) with the UV light and sets "90 mA" as the current value in the second light irradiation mode that irradiates the image in which the setting value of the glossiness is high (gloss) with the UV light, in a case where the distance L calculated as described above is the second distance that is less than the threshold N.

That is, the CPU 41 sets a value greater than the current value in the second light irradiation mode as the current value in the first light irradiation mode in a case where the distance L calculated as described above is the second distance that is less than the threshold N, similar to the case where the distance calculated as described above is the first distance that is the threshold N or more. Furthermore, the CPU 41 sets a current value relatively smaller than in one of the first light irradiation mode and the second light irradiation mode in a case where the distance L calculated as described above is the second distance that is less than the threshold N, compared to a case where the distance calculated as described above is the first distance that is the threshold N or more.

Successively, the CPU 41 controls the driving of the head driver 48 based on the print job J2 read from the RAM 43 while controlling the driving of the carriage motor 27.

Figure 7:
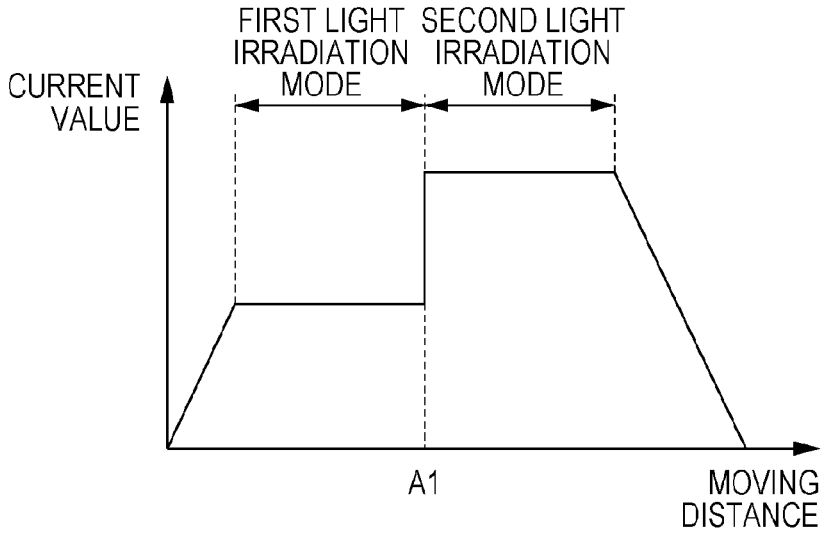
FIG. 7 is a graph illustrating a correlation between a moving distance of the carriage and the current value supplied to the LED.

In this case, as illustrated in FIG. 7, first, the CPU 41 sets the current value in the first light irradiation mode as the current value of the current supplied from the LED driver 45 to the LED 46 while the carriage 23 crosses over the medium P on the mounting surface 13 of the base stand 12. Then, the CPU 41 increases the current value of the current supplied from the LED driver 45 to the LED 46 to the current value in the second light irradiation mode when the moving distance of the carriage 23 reaches a distance A1.

That is, the CPU 41 executes the first light irradiation mode and the second light irradiation mode of which intensities of the UV light applied from the irradiator 35 to the medium P are different from each other while the carriage motor 27 moves the irradiator 35 in one direction. Thus, the intensity of the UV light applied from the irradiator 35 to the medium P is changed while the carriage motor 27 moves the irradiator 35 in one direction.

Figure 8:
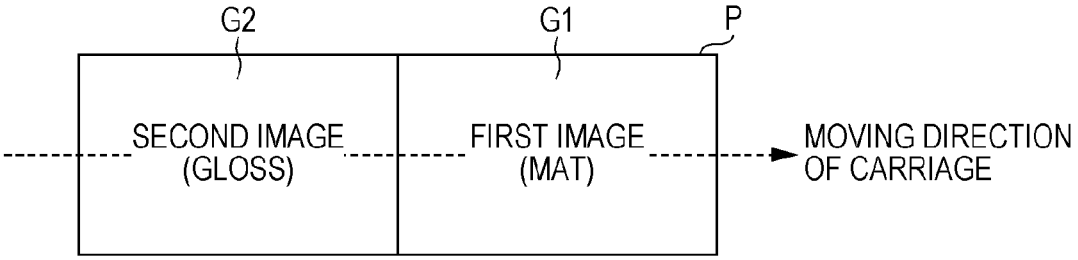
FIG. 8 is a schematic view illustrating contents of an image formed on the medium.

Then, as illustrated in FIG. 8, the UV light having the first intensity that is relatively low intensity, is applied from the irradiator 35 to the ejected UV ink on a rear side of the medium P on the mounting surface 13 of the base stand 12 in the moving direction of the carriage 23, immediately after the UV ink is ejected from the liquid ejecting head 32. As a result, since the UV ink ejected onto the medium P is cured after the UV ink wet spreads, the second image G2 of which the glossiness is high (gloss) is formed.

On the other hand, the UV light having the second intensity that is relatively high intensity, is applied from the irradiator 35 to the ejected UV ink on a front side of the medium P on the mounting surface 13 of the base stand 12 in the moving direction of the carriage 23, immediately after the UV ink is ejected from the liquid ejecting head 32. As a result, since the UV ink ejected onto the medium P is cured before the UV ink wet spreads, the first image G1 of which the glossiness is low (mat) is formed.

Next, an operation of the printer 10 having such a configuration will be described.

Now, in the embodiment, the image having different glosses is formed on the medium P by changing the intensity of the UV light applied from the irradiator 35 to the UV ink ejected onto the medium P while the carriage 23 is moved in one direction so as to cross over the medium P on the mounting surface 13 of the base stand 12. Therefore, even in a case of forming the image having different glosses on the medium P, it is not essential that the movement of the carriage 23 be repeated in one direction whenever changing the gloss of the image formed on the medium P. Thus, it is possible to efficiently form the image having different glosses on the medium P on the mounting surface 13 of the base stand 12.

Specifically, if a size of the medium P corresponds to an entire region of the mounting surface 13 of the base stand 12, openings of all suction holes 14 are closed by the medium P in the mounting surface 13 of the base stand 12. Thus, differently from a case where the suction holes 14 that are open without being closed by the medium P exist, in order to ensure the suction force of the medium P with respect to the mounting surface 13 of the base stand 12, it is not necessary to close the openings of the suction holes 14 which are not closed by the medium P with another member that is different from the medium P. Thus, it is possible to efficiently perform the print having high quality from the liquid ejecting head 32 to the medium P while a flatness of the medium P is secured by sucking the medium P with respect to the mounting surface 13 of the base stand 12.

Furthermore, in the embodiment, first, the irradiator 35 irradiates the second image G2 formed on the medium P with the UV light having relatively low intensity and then the intensity of the UV light applied to the first image G1 formed on the medium P is increased while moving in one direction so as to cross over the medium P on the mounting surface 13 of the base stand 12.

Figure 9:
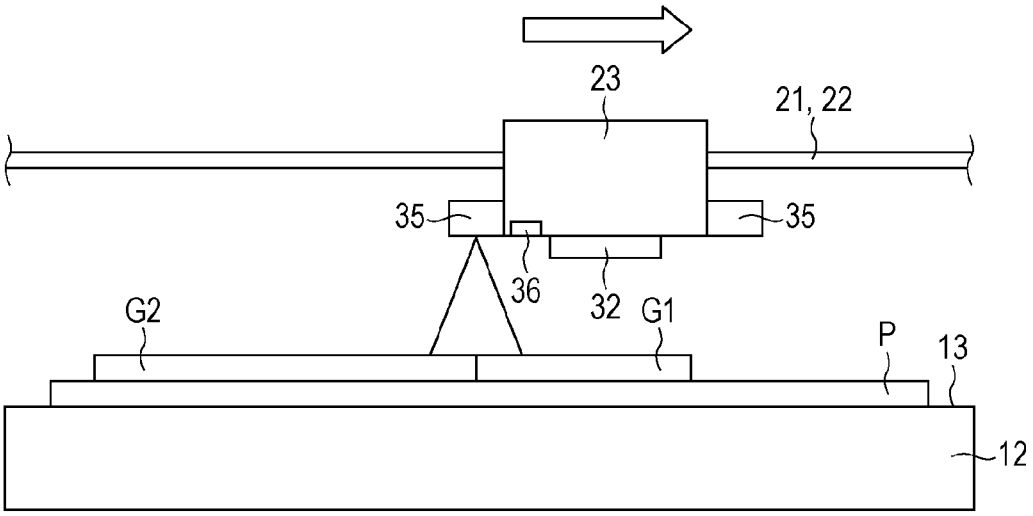
FIG. 9 is a schematic view illustrating the peripheral configuration of the carriage before and after the irradiation conditions are switched.

Thus, as illustrated in FIG. 9, when the moving distance of the carriage 23 reaches the distance A1 and an object to which the UV light is applied from the irradiator 35 is switched from the second image G2 to the first image G1, the intensity of the UV light applied from the irradiator 35 to the UV ink ejected onto the medium P is increased. In this case, since the UV light having relatively low intensity has already been applied from the irradiator 35 to the second image G2, it becomes a state where the UV ink is cured. As a result, immediately after the intensity of the UV light applied from the irradiator 35 to the UV ink ejected onto the medium P is increased, even if some of the UV light having relatively high intensity is applied from the irradiator 35 to an end portion of the second image G2 formed on the medium P, the curing of the UV ink is further processed in the end portion of the second image G2 and the glossiness of the second image G2 is unlikely to be changed thereby.

According to the first embodiment described above, it is possible to obtain the following effects.

(1) The image having different glosses is formed on the medium P by changing the intensity of the UV light applied from the irradiator 35 to the UV ink ejected onto the medium P while the irradiator 35 is moved in one direction. Thus, it is possible to efficiently form the image having different glosses.

(2) The image having different glosses is formed on the medium P by executing a plurality of light irradiation modes in which the intensities of the UV light applied from the irradiator 35 to the UV ink ejected onto the medium P are different from each other while the irradiator 35 is moved in one direction. Thus, it is possible to efficiently form the image having different glosses.

(3) The intensity of the UV light applied from the irradiator 35 to the UV ink ejected onto the medium P is maintained by changing the intensity of the UV light applied from the irradiator 35 to the UV ink ejected onto the medium P depending on the change of the distance between the irradiator 35 and the medium P. Therefore, it is possible to form the image having a desired gloss on the medium P even if the distance between the irradiator 35 and the medium P is changed.

(4) The irradiator 35 irradiates the UV ink ejected onto the medium P with the UV light having the first intensity and then the intensity of the UV light applied to the UV ink ejected onto the medium P is increased from the first intensity to the second intensity while moving in one direction. Thus, even if the intensity of the UV light applied from the irradiator 35 to the UV ink ejected onto the medium P is continuously changed while the irradiator 35 is moved in one direction, it is possible to suppress influence to the glossiness of the image formed on a boundary thereof.

(5) The image to which the light having the first intensity is applied is formed on the rear side in the moving direction of the irradiator 35 and the image to which the light having the second intensity is applied is formed on the front side in the moving direction of the irradiator 35 by switching the order of the print jobs. Thus, it is possible to reliably realize a configuration in which the UV light having the first intensity is applied from the irradiator 35 to the position of the rear side in the moving direction of the irradiator 35 in the medium P and the UV light having the second intensity that is greater than the first intensity is applied from the irradiator 35 to the front side in the moving direction of the irradiator 35 in the medium P while the irradiator 35 is moved in one direction.

Second Embodiment

Next, a second embodiment will be described. The second embodiment is different from the first embodiment in that the image is formed on a plurality of media while the carriage 23 is moved in one direction. Therefore, in the following description, a configuration different from that of the first embodiment is mainly described and the same reference numerals are given to the same or corresponding configuration of the first embodiment and description thereof is omitted.

Figure 10:
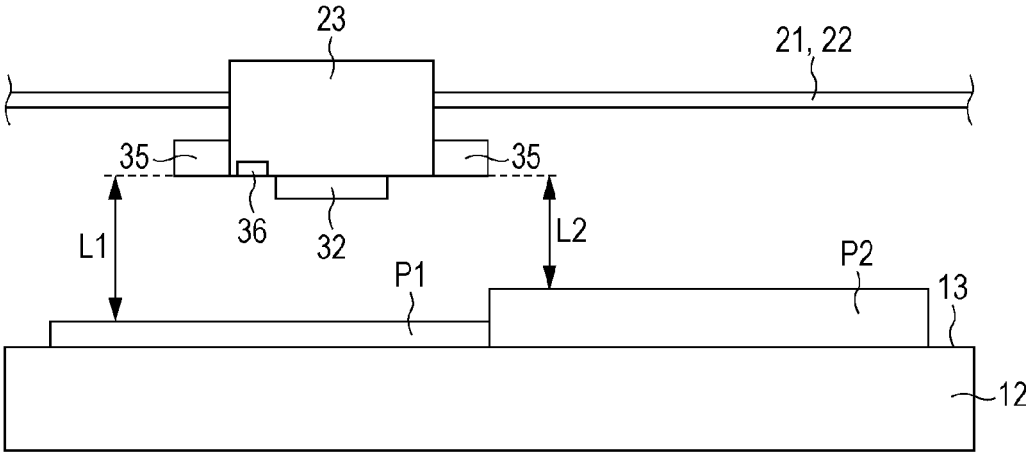
FIG. 10 is a schematic view illustrating the peripheral configuration of the carriage in a printer of a second embodiment.

As illustrated in FIG. 10, in the embodiment, a plurality of media P1 and P2 having different thicknesses are arranged and mounted on a mounting surface 13 of a base stand 12 in the moving direction of the carriage 23. Specifically, a first medium P1 is mounted on a rear side (left side in FIG. 10) in the moving direction of the carriage 23 and a second medium P2 having a thickness thicker than that of the first medium P1 is mounted on the front side (right side in FIG. 10) in the moving direction of the carriage 23 of the mounting surface 13 of the base station 12. In this case, a distance L1 between the irradiator 35 and the first medium P1 is larger than a distance L2 between the irradiator 35 and the second medium P2.

Figure 11:
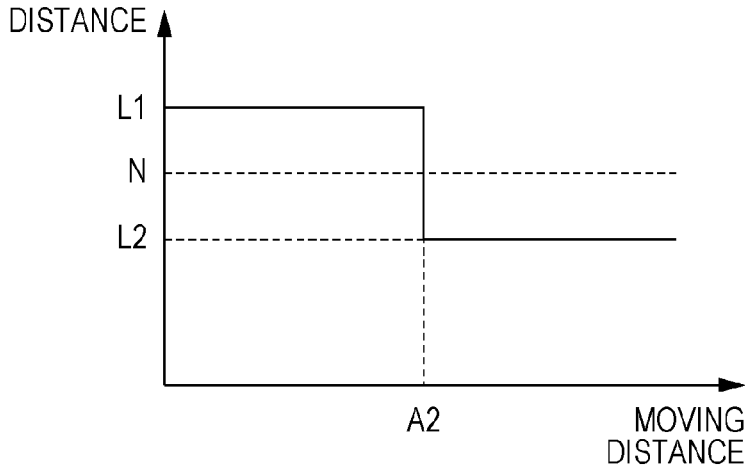
FIG. 11 is a graph illustrating a correlation between a moving distance of a carriage and a medium.

Thus, as illustrated in FIG. 11, a CPU 41 calculates first the distance L1 as the distance between the irradiator 35 and the first medium P1, based on a measurement signal that is input from a distance sensor 36 while the carriage 23 crosses over the media P1 and P2 on the mounting surface 13 of the base stand 12. Then, the CPU 41 calculates the distance L2 that is smaller than the distance L1 as a distance between the irradiator 35 and the second medium P2 when the moving distance of the carriage 23 reaches a distance A2. Moreover, in the embodiment, the distance L1 between the irradiator 35 and the first medium P1 is larger than a threshold N that is a determination reference when changing the intensity of the irradiation from the irradiator 35 to the media P1 and P2 and the distance L2 between the irradiator 35 and the second medium P2 is smaller than the threshold N.

Furthermore, in the embodiment, data of the image formed on each of the media P1 and P2 are set in the print job input from the outside corresponding to kinds of each of the media P1 and P2. Then, the CPU 41 recognizes the kinds of each of the media P1 and P2 mounted on the mounting surface 13 of the base stand 12 and reads the setting value of the glossiness of the recognized image formed on each of the media P1 and P2 from the ROM 42 based on a calculation result of the distance between the irradiator 35 and each of the media P1 and P2.

Figure 12:
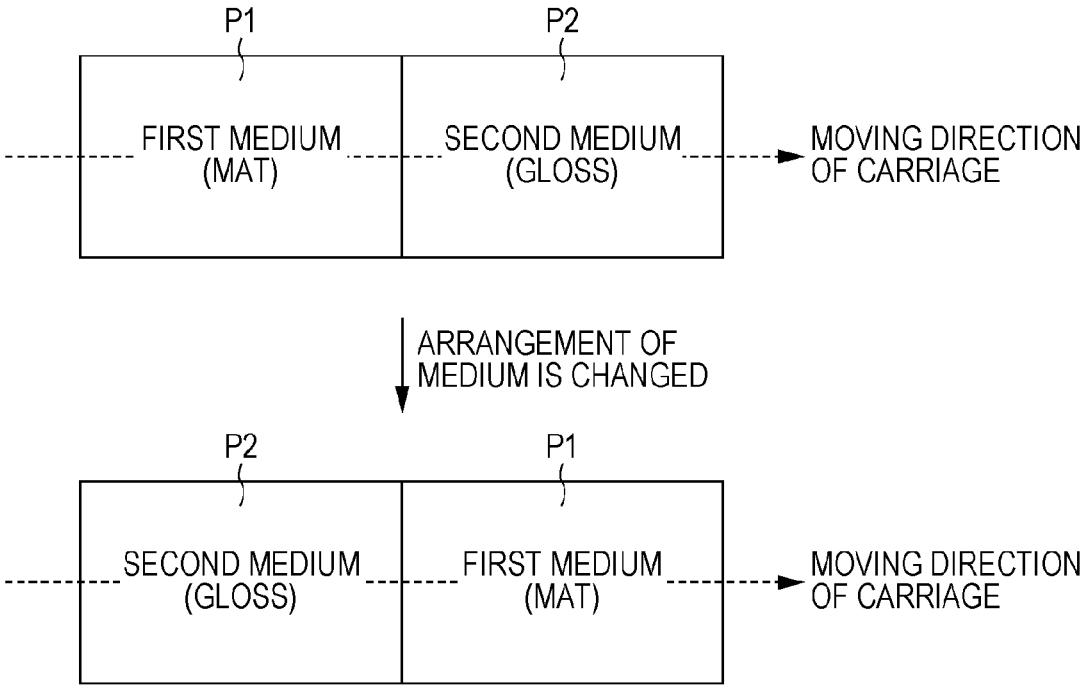
FIG. 12 is a schematic view illustrating a positional relationship of the medium with respect to a moving direction of the carriage before and after disposition of the medium is changed.

In the example illustrated in FIG. 12, in the print job that is input from the outside, the first image G1 of which the glossiness is low (mat) as the image formed on the first medium P1 is set corresponding to the first medium P1 and the second image G2 of which the glossiness is high (gloss) as the image formed on the second medium P2 is set corresponding to the second medium P2. Then, the CPU 41 recognizes that the second medium P2 is positioned on the front side in the moving direction of the carriage 23 and the first medium P1 is positioned on the rear side in the moving direction of the carriage 23, based on a calculation result regarding the distance between the irradiator 35 and each of the media P1 and P2. Furthermore, the CPU 41 reads "mat" as the setting value of the glossiness of the first image G1 formed on the first medium P1 and reads "gloss" as the setting value of the glossiness of the second image G2 formed on the second medium P2.

That is, in the example illustrated in FIG. 12, as the order of the printing of the image in the print job that is input, first, the first image G1 of which the setting value of the glossiness is low (mat) is printed and then the second image G2 of which the setting value of the glossiness is large (gloss) is printed.

Thus, the CPU 41 updates the print job to a new print job in which the order of the images G1 and G2 is switched and the updated print job is stored in the RAM 43. Furthermore, the CPU 41 causes notification prompting the change of the arrangement of each of the media P1 and P2 mounted on the mounting surface 13 of the base stand 12 to be displayed on an operation screen (not illustrated) of the printer 10 as an example of a notification section correspond to switching of the order of the printing with respect to each of the media P1 and P2.

Figures 13, 14:
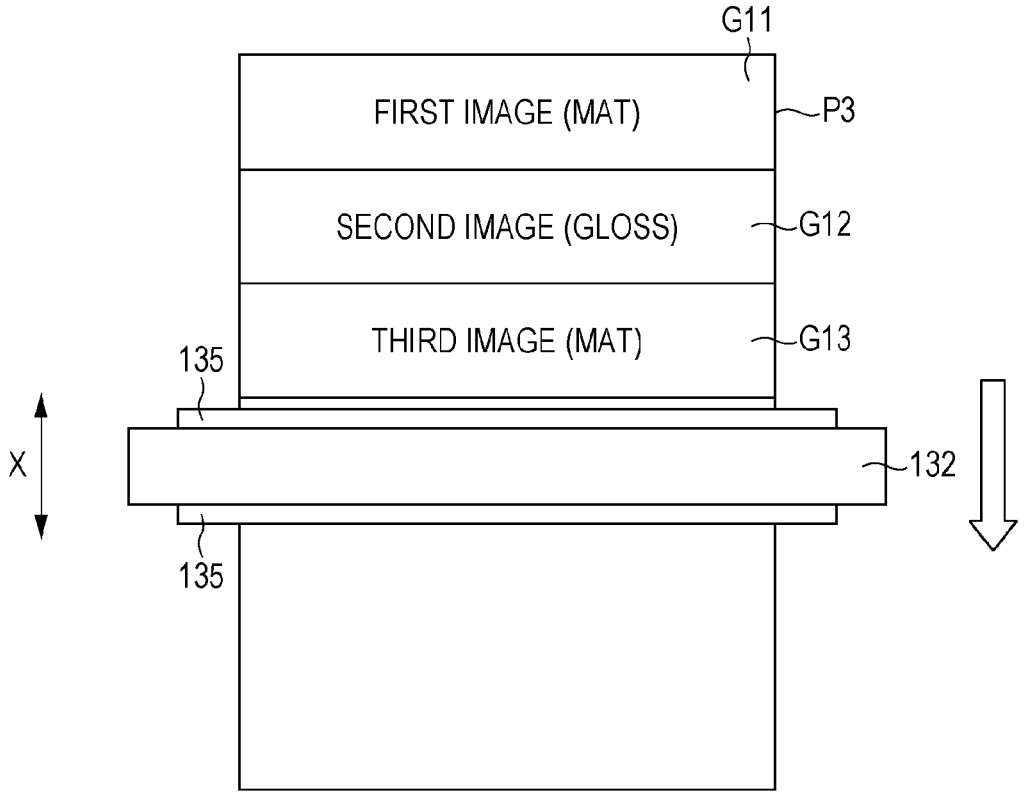
FIG. 13 is a schematic view illustrating setting contents of current values supplied to an LED.
FIG. 14 is a schematic plan view illustrating a printer of another embodiment.

In this case, as illustrated in FIG. 13, the CPU 41 sets "200 mA" as the current value in the first light irradiation mode that is the irradiation mode with respect to the first medium P1 and sets "90 mA" as the current value in the second light irradiation mode that is the irradiation mode with respect to the second medium P2.

According to the second embodiment described above, it is possible to obtain the following effect in addition to the effects (1) to (5) of the first embodiment described above.

(6) In a case of arranging each of the media P1 and P2 according to the notification through the operation screen and the like of the printer 10, the second medium P2 on which the second image G2 is formed to which the light having the first intensity is applied is disposed on the rear side in the moving direction of the irradiator 35 and the first medium P1 on which the first image G1 is formed to which the light having the second intensity is applied is disposed on the front side in the moving direction of the irradiator 35. Thus, it is possible to reliably realize the configuration in which the light having the first intensity is applied from the irradiator 35 to the second medium P2 positioned on the rear side in the moving direction of the irradiator 35 and the light having the second intensity that is greater than the first intensity is applied from the irradiator 35 to the first medium P1 positioned on the front side in the moving direction of the irradiator 35 while the irradiator 35 is moved in one direction.

Moreover, each of embodiments described above may be changed to the following other embodiments.

As illustrated in FIG. 14, the printer 10 in each of embodiments described above may include a line head type liquid ejecting head 132 having nozzle columns over an entire region in a width direction of a medium P3. In this case, the liquid ejecting head 132 is moved in a longitudinal direction X of the medium P3 together with the liquid ejecting unit 20. Furthermore, irradiators 135 are supported on both sides of the liquid ejecting head 132 in the moving direction of the liquid ejecting head 132. Then, each of the irradiators 135 cures the UV ink by applying the UV light on the UV ink ejected onto the medium P.

Then, when the liquid ejecting unit 20 moves in the longitudinal direction X of the medium P3 with respect to the base stand 12, the liquid ejecting head 132 is moved so as to cross over the medium P3 on the mounting surface 13 of the base stand 12. Furthermore, the printing is performed on the medium P3 by ejecting the UV ink from the liquid ejecting head 132 to the medium P3 in the process of the movement. Furthermore, the UV ink is cured by applying the UV light from the irradiators 135 to the UV ink ejected onto the medium P3.

In the configuration, a plurality of images (a first image G11, a second image G12, and a third image G13) of which the glosses are different from each other to the medium P3 are formed by changing the intensity of the UV light applied from the irradiators 135 to the UV ink ejected onto the medium P3 while the liquid ejecting head 132 crosses over the medium P3 on the mounting surface 13 of the base stand 12.

As the order of printing of the images in the print job J1 that is input in each of embodiments described above, even in a case where, first, the image in which the setting value of the glossiness is low (mat) is printed and then the image in which the setting value of the glossiness is high (gloss) is printed, the CPU 41 may perform the printing with respect to the media P, P1, and P2 without switching the order of the print jobs that is input from the outside.

In this configuration, the light having the second intensity is applied from the irradiator to the medium or a portion of the medium positioned on the rear side in the moving direction of the irradiator 35 and the light having the first intensity that is smaller than the second intensity is applied from the irradiator 35 to the medium or a portion of the medium positioned on the front side in the moving direction of the irradiator 35.

Each of the embodiments described above may be configured such that the intensity of the UV light applied from the irradiator 35 to the UV ink ejected on the media P, P1, and P2 is not changed depending on the distance between the irradiator 35 and each of the media P1 and P2. In this case, the distance sensor 36 measuring the distance between the irradiator 35 and the media P, P1, and P2 may be omitted.

The liquid ejecting apparatus of each of the embodiments described above may be a liquid ejecting apparatus that ejects or discharges a liquid other than the ink if the liquid is of a light-curable type. Moreover, as a state of the liquid ejected in a form of liquid droplets of a minute amount from the liquid ejecting apparatus, a grain shape, a tear shape, and one leaving a trail in a thread shape are also included. Furthermore, the liquid referred to here may be a material the can be ejected from the liquid ejecting apparatus. For example, a state in which the material is in a liquid phase is good, and a liquid-like body having a high or low viscosity, a sol, gel water, and a fluid-like body such as an inorganic solvent, an organic solvent, a liquid, a liquid-like resin, and a liquid-like metal (molten metal) are included. Furthermore, a material in which particles of a functional material consisting of solids such as pigments or metal particles are dissolved, dispersed, or mixed into a solvent is also included in addition to the liquid as one aspect of the material. As a representative example of the liquid, the ink as described in the above embodiments, a liquid crystal, or the like is exemplified. Here, the ink includes various liquid compositions such as a general water-based ink, oil-based ink, gel ink, and hot melt ink. As a specific example of the liquid ejecting apparatus, for example, there is a liquid ejecting apparatus that ejects a liquid containing a dispersed or melted material such as an electrode material or a color material that is used for manufacturing a liquid crystal display, an electroluminescence (EL) display, a surface emitting display, and a color filter. Furthermore, a liquid ejecting apparatus that ejects biological organic matter that is used for manufacturing biochips, a liquid ejecting apparatus that ejects a liquid as a sample used for a precision pipette, a textile printing apparatus, a micro-dispenser, or the like may be included. Furthermore, a liquid ejecting apparatus that ejects lubricant from a pin point to a precision machine such as a watch or a camera, and a liquid ejecting apparatus that ejects a transparent resin liquid such as an ultraviolet curable resin to form a minute hemispherical lens (optical lens) and the like used in an optical communication element and the like on a substrate may be included. A liquid ejecting apparatus that ejects an etching liquid such as an acid or an alkali for etching a substrate and the like may be included.

The entire disclosure of Japanese Patent Application No. 2013-207964, filed Oct. 3, 2014 is expressly incorporated by reference herein.

What is claimed is:

1. A liquid ejecting apparatus comprising:

a liquid ejecting section that ejects light-curable liquid onto a plurality of media while the liquid ejecting section moves in a predetermined direction;

a light irradiation section that irradiates the liquid ejected onto the plurality of media with light, and cures the liquid;

a control section that controls intensity of the light applied from the light irradiation section to the plurality of media;

a measuring section that measures a distance between the light irradiation section and the plurality of media; and a driving section that moves the light irradiation section and the liquid ejecting section in the predetermined direction, wherein the control section changes the intensity of the light applied from the light irradiation section to the plurality of media while the driving section moves the light irradiation section in the predetermined direction, wherein the control section changes the intensity of the light applied from the light irradiation section to the plurality of media in a case where the distance measured by the measuring section is a first distance between the light irradiation section and a first medium of the plurality of media, as compared to a case where the distance measured by the measuring section is a second distance between the light irradiation section and to a second medium of the plurality of media that is smaller than the first distance, wherein the light intensity is changed as light irradiation section moves from being opposite the first medium to being opposite the second medium.

2. The liquid ejecting apparatus according to claim 1, wherein the control section causes a plurality of light irradiation modes in which the intensities of the light applied from the light irradiation section to the plurality of media are different from each other to be executed while the driving section moves the light irradiation section in the predetermined direction.

3. The liquid ejecting apparatus according to claim 1, wherein the control section causes the light having a first intensity to be applied from the light irradiation section to the first medium of the plurality of media that is positioned on the rear side in the moving direction of the light irradiation section, and causes the light having a second intensity that is smaller than the first intensity to be applied from the light irradiation section to the second medium of the plurality of media that is positioned on the front side in the moving direction of the light irradiation section.

4. The liquid ejecting apparatus according to claim 3, further comprising:

a notification section that notifies the disposition of the first medium to which the light having the first intensity from the light irradiation section is applied on the rear side in the moving direction of the light irradiation section and notifies the disposition of the second medium to which the light having the second intensity from the liquid ejecting section is applied on the front side in the moving direction of the light irradiation section.

5. A liquid ejecting apparatus comprising:

a liquid ejecting section that ejects light-curable liquid onto a plurality of media while the liquid ejecting section moves in a predetermined direction;

a light irradiation section that irradiates the liquid ejected onto the plurality of media with light, and cures the liquid;

a control section that controls intensity of the light applied from the light irradiation section to the plurality of media; and a driving section that moves the light irradiation section and the liquid ejecting section in the predetermined direction, wherein the control section changes the intensity of the light applied from the light irradiation section to the plurality of media while the driving section moves the light irradiation section in the predetermined direction, wherein the control section causes the light having a first intensity to be applied from the light irradiation section to a first medium of the plurality of media that is positioned on a rear side in a moving direction of the light irradiation section, and causes the light having a second intensity that is greater than the first intensity to be applied from the light irradiation section to a second medium of the plurality of media that is positioned on a front side in the moving direction of the light irradiation section while the driving section moves the light irradiation section from being opposite the first medium to being opposite the second medium, wherein a first distance between the light irradiation section and the first medium of the plurality of media is greater than a second distance between the light irradiation section and the second medium of the plurality of media.

6. The liquid ejecting apparatus according to claim 5, further comprising:

an ejection control section that controls ejection modes of the liquid ejected from the liquid ejecting section onto the plurality of media, wherein the ejection control section generates liquid ejection jobs so as to execute a first liquid ejection job and a second liquid ejection job in order while the liquid ejecting section is moved in the moving direction of the light irradiation section, and in a case where the intensity of the light applied to the image formed by the first liquid ejection job is greater than that of the light applied to the image formed by the second liquid ejection job, the order of the first liquid ejection job and the second liquid ejection job in the liquid ejection jobs is switched.

* * * * *